United States Patent [19]

Hunter

[11] Patent Number: 4,934,713

[45] Date of Patent: Jun. 19, 1990

[54] BOOMERANG

[76] Inventor: Bruce A. Hunter, 2816 W. McKinley Blvd., Milwaukee, Wis. 53208

[21] Appl. No.: 351,574

[22] Filed: May 15, 1989

[51] Int. Cl.[5] ..... A63B 65/08

[52] U.S. Cl. ..... 273/425; 273/426

[58] Field of Search ..... 273/426, 425; D21/85, D21/86, 203; 446/48

[56] References Cited

U.S. PATENT DOCUMENTS

| | | | |
|---|---|---|---|
| D. 253,004 | 9/1979 | Meckstroth | 446/48 X |
| 2,972,481 | 2/1961 | Shapiro | 273/426 |
| 3,082,572 | 3/1963 | Knox, Jr. | 273/426 X |
| 4,216,962 | 8/1980 | Flemming | 273/426 |
| 4,307,535 | 12/1981 | Martin | 273/426 X |
| 4,772,030 | 9/1988 | Hunt | 273/426 |

*Primary Examiner*—Paul E. Shapiro

*Attorney, Agent, or Firm*—Fuller, Ryan & Hohenfeldt

[57] ABSTRACT

A boomerang in the form of a generally planar ring having a circular outer edge and an inner opening. The opening is shaped so that equiangularly spaced apart planar wing elements are formed which have greater radial width than the portions of the rings which span between them. Each wing has a symmetrical V-shaped airfoil protruding from it so that the boomerang exhibits similar aerodynamic properties whether it is thrown by a left or right-handed person.

6 Claims, 1 Drawing Sheet

BOOMERANG

BACKGROUND OF THE INVENTION

This invention pertains to a device which has the characteristics of a boomerang, that is, if the device is thrown into the air it goes away from the thrower, turns around and comes back to the thrower.

Many boomerang devices have been developed. Some of them are much like multiple bladed propellers which can do substantial harm if they hit a person other than the thrower and they can harm the thrower if the thrower attempts to catch the device. Most, if, not all, prior boomerang devices are designed for being thrown by right-handed persons. If they are thrown by left-handed persons, they will usually rotate in a direction which results in airfoil members of the device tending to drive it downwardly when thrown rather than upwardly. Thus, it is difficult for left-handed persons to make the device fly over a distance which is satisfying to the person.

SUMMARY OF THE INVENTION

The boomerang described herein is comprised of a generally planar ring which has a plurality of radially inwardly widened equiangularly spaced apart mostly planar segments which constitute wing segments. From each of the wing segments an airfoil member protrudes. The airfoil members are V-shaped in crosssection and present two intersecting surfaces similar to isosceles or equilateral triangles. In other words, an airfoil has an apex and two sides of a triangle diverging away from it so there is a surface of the airfoil which is properly angulated for producing a lifting force on the ring when the boomerang ring is thrown so it rotates in either direction. Thus, successful use of the boomerang does not depend on whether it is thrown by a left or right-handed person.

An added feature of the new boomerang is that it is designed for being mass produced such as by injection molding.

The boomerang ring also features a continuous outside circular rim which presents no sharp edges or corners that would be likely to injure a person who is struck by the boomerang or who tries to catch the boomerang.

A detailed description of a preferred embodiment of the new boomerang will now be set forth, in reference to the accompanying drawings.

DESCRIPTION OF THE PREFERRED EMBODIMENT

Figure 1:
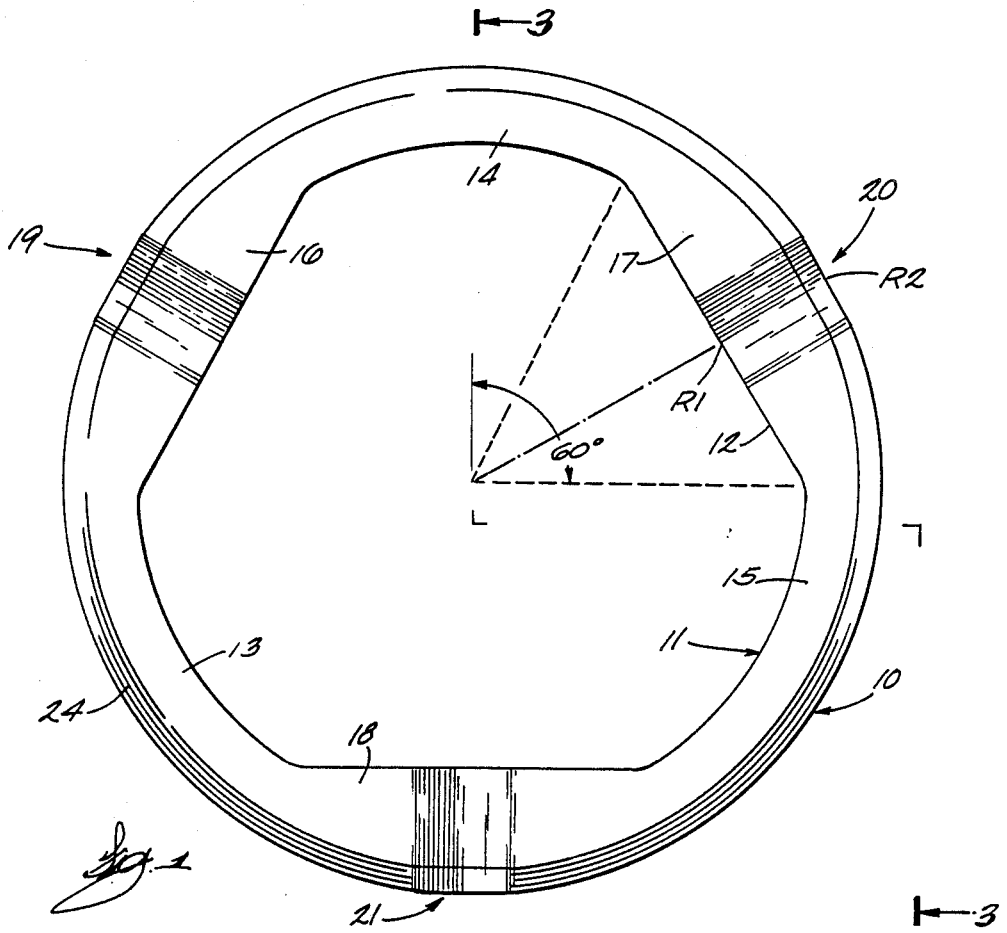
FIG. 1 is a top plan view of the new boomerang.

The boomerang comprises a ring which is generally planar and has an outer circular edge 10 and a central opening defined by an inner margin which has curved portions which are designated by the numeral 11 and straight edge portions which are designated by the numeral 12. The straight edge portions 12 can be considered to be chords of a circle. For the most part there are three circular segments 13, 14 and 15 of the ring in the illustrative embodiment which have equal width. That is, the width measured between the inner curved margin 11 and the outer circular edge 10 is equal for the three sections 13, 14 and 15 of the ring. These sections, being flat, help the ring slice through the air when it is thrown.

The ring also includes three equally spaced apart planar segments 16, 17 and 18 which have a greater radial width than the segments 13–15 which interconnect them. The radially wider segments 16–18 constitute wing elements which impart aerodynamic stability to the boomerang ring when it is thrown. The length of the straight chordal edges 12 is such that they subtend central angles of 60°. Radius $R_1$, is preferably about 70% of radius $R_2$. The line on which the angulated airfoil surfaces intersect lies on a radius of the ring. This radius is perpendicular to chordal lines 12 and the radius bisects the lines.

Figure 2:
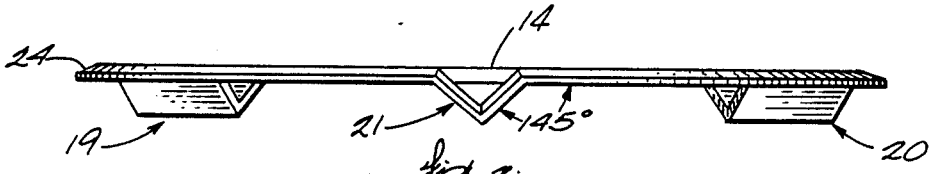
FIGS. 2 is a side elevational view of the boomerang.
Figure 3:
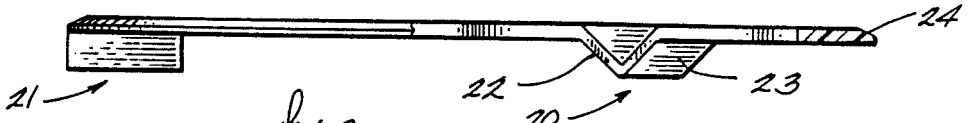
FIG. 3 is an elevational view, partly in section, wherein the section is taken on the irregular line corresponding to 3—3 in FIG. 1.

Airfoil members 19, 20 and 21 protrude in the same axial direction from the planar wing element segments 16–18. As can be seen in FIGS. 2 and 3 particularly well, the airfoil members 19–21 are triangular or V-shaped in cross section and anyone of them, typified by airfoil 20, has two surfaces 22 and 23 which are the sides of an isosceles or equilateral triangle. Surfaces 22 and 23 intersect on a radially extending line 25. Looking at airfoil 21 in FIG. 2, one will see that, by way of example and not limitation, the angle of each side of the triangle in the illustrative model is about 145°. Because of symmetry of the triangular or V-shaped airfoil sides one may see that the attack angle of the airfoil and consequently the lifting force on the ring will be the same regardless of the direction in which it is rotating in flight. An attack angle, that is, a slant of airfoil surface 22 and 23 of 35° is illustrative but can be considered preferred. It has been found that changing the angle changes the distance from the thrower at which the boomerang turns around and starts returning toward the thrower. The angles could be varied between 25° and 45°.

In the illustrative embodiment, only three wider wing elements 16–18 and three airfoil members 19–21 are provided. Providing for four airfoils and a corresponding number of wing portions has been found to produce a satisfactorily performing boomerang. It is conceivable that as many as six airfoils might be used.

Having the wing segments 16–18 wider than the interconnecting circular segments 13–15 is necessary to obtain stable and predictable flight. Note that the ring has a bevelled edge 24. This also, contributes to stable flight.

By way of example and not limitation, a ring having an outside diameter of 13.5 inches seems to be most appropriate. In such case the maximum width of the wing elements is preferably about 2 inches. Good flight has been obtained from test models which have outside diameters in the range of 12–16 inches. A typical ring is one-fourth of an inch thick.

The boomerang ring may be made of a variety of materials, preferably plastics to facilitate molding. Boomerangs made of light weight rigid materials are preferred for competitive activity. Models preferred for use by children are preferably made of foamed plastic material.

Use of the boomerang involves throwing it forwardly and upwardly at an angle of about 45° relative to horizontal. The ring is thrown in an overhand fashion preferably in parallelism with a vertical plane, that is, the axis of the ring is horizontal when it is released from the thrower's hand. The ring goes out from the thrower on a trajectory which depends to some extent on the angle at which it is released. For not easily explained aerodynamic reasons, the ring goes out to a particular distance, depending upon the force with which it is thrown, and makes a return loop so as to start coming back toward the thrower. At this time, the ring assumes flight in a horizontal plane. With practice the thrower increases the probability of catching the boomerang before it lands on the ground. The boomerang is thrown into the wind, if any exists, and returns with the wind.

Although an embodiment of the invention has been described in detail, such description is intended to be illustrative rather than limiting, for the, invention may be variously embodied and is to be limited only by interpretation of the claims which follow.

I claim:

1. A boomerang comprising a generally planar ring having an outer circular edge and a central opening bounded in part by an inner circular margin that is displaced radially inwardly of said outer circular edge, a plurality of equiangularly spaced apart planar segments of said ring constituting wing elements respectively bounded by said outer circular edge and radially inwardly presented edges to each of which a radius of said ring is perpendicular, said wing elements having greater widths in the radial direction measured between said outer circular edge and said radially inwardly presented edges of the opening than the width of the ring portions which extend between said wing elements and, an airfoil member protruding in the same axial direction from each of said wing elements midway of the length of said radially inwardly presented edges, respectively, said airfoil member having a V-shaped cross section.

2. A boomerang comprising a generally planar ring having an outer circular edge and a central opening defined by an inner margin that is displaced radially inwardly of said circular edge, a plurality of equiangularly spaced apart planar segments of said ring constituting wing elements which have greater widths in the radial direction measured between said outer circular edge and said margin of the opening than the width of the ring portions between said wing elements and an airfoil member protruding in the same axial direction from each of said wing elements, said airfoil member having two flat sides which deviate from the plane of said ring at opposite but equal angles so as to intersect along a line coincident with a radius of the ring.

3. The boomerang according to claim 2 wherein said angles are each about 135°.

4. The boomerang according to claim 2 wherein the outside diameter of said ring is about 13.5 inches and the line along which said sides of the airfoil intersect is about 2 inches long.

5. The boomerang according to claim 2 wherein the length of said line along which said sides intersect is equal to about 30% of the length of a radius of said outer circular edge

6. The boomerang according to claim 2 wherein the inner margin of a wing element is on a chordal line to which a radius of said ring is perpendicular and said radius crosses said chordal line midway between its ends, said radius also being aligned with said line along which said sides of the airfoil intersect.

* * * * *